United States Patent [19]

Sadao

[11] 4,404,774

[45] Sep. 20, 1983

[54] GRINDING MACHINE WITH A METHOD FOR SECURING DIMENSIONAL ACCURACY

[75] Inventor: Yamanaka Sadao, Chigasaki, Japan

[73] Assignee: Nippon Thompson, Co., Ltd., Tokyo, Japan

[21] Appl. No.: 299,162

[22] Filed: Sep. 3, 1981

Related U.S. Application Data

[62] Division of Ser. No. 877,762, Feb. 14, 1978, abandoned.

[30] Foreign Application Priority Data

Feb. 15, 1977 [JP] Japan ..... 52-15968

[51] Int. Cl.[3] ..... B24B 53/00

[52] U.S. Cl. ..... 51/325; 51/5 D; 51/165.81; 51/165.87

[58] Field of Search ..... 125/11 R, 11 CD, 11 GA; 51/5 D, 165.81, 165.87, 49, 165.93, 325

[56] References Cited

U.S. PATENT DOCUMENTS

| | | | |
|---|---|---|---|
| 1,626,232 | 4/1927 | Gayarin | 125/11 BA |
| 1,649,713 | 11/1927 | Lofquist | 51/165.93 |
| 2,390,967 | 12/1945 | Svenson | 51/165:81 |
| 2,429,830 | 10/1947 | Ljunggren | 51/165.81 |
| 3,353,302 | 11/1967 | Lowy | 51/49 |
| 3,378,001 | 4/1968 | Parapetti | 125/11 R |
| 4,044,506 | 8/1977 | Taketa | 51/5 D |

*Primary Examiner*—Harold D. Whitehead

*Attorney, Agent, or Firm*—L. Lawton Rogers, III

[57] ABSTRACT

A device for use in a grinding machine for securing an accurate depth of grinding feed of a grinding wheel against a work so as to conduct a grinding operation on a work to a desired grinding accuracy. A diamond tip is adjustably mounted on the device so as to be caused to touch operatively the circumferential surface of the grinding wheel which is fed to a predetermined depth of grinding feed toward the work during a grinding operation cycle, thereby to define the desired dimension of the work so prescribed.

1 Claim, 6 Drawing Figures

GRINDING MACHINE WITH A METHOD FOR SECURING DIMENSIONAL ACCURACY

This is a division of application Ser. No. 877,762, filed Feb. 14, 1978, and now abandoned.

BACKGROUND OF THE INVENTION

The present invention relates in general to a device for securing an accurate depth of grinding feed of an abrasive or grinding wheel toward a work for use in a grinding machine, and more particularly to a device for positively enabling an accurate dimensional control performance, i.e., predetermination of dimensional accuracy and maintenance of surface roughness accuracy of a work in a grinding operation.

There have been generally known a diamond dresser adapted to grind concave or convex surfaces as well as a diamond dresser adaptable for angular grinding operation. These diamond dressers are known to be effective to obtain a finish of desired cumber or curvature and angular surface on an abrasive or grinding wheel of a grinding machine. In such conventional apparatus, it is practicably possible to attain a desired accuracy in the dressing work on the grinding wheel, provided that the setting conditions are met definitely.

In the conventional method of grinding a work to a desired dimension, it is conducted in such a manner that a depth of feed is predetermined on a grinding machine, then a work is ground to a desired dimension with such predetermined setting of dimension being maintained during the grinding operation. For instance, such procedure of maintaining is practiced by the steps of leading a movable grinding wheel support or feed rest toward the work by using of a feed screw, and when the depth of grinding feed reaches a predetermined setting, stopping the feed motion of the grinding wheel support by function of a stopper mechanism.

With such prior art arrangement, however, when conducting grinding operations on a plurality of works to be ground, it was practicably difficult to obtain all the works finished to the same dimensional accuracy and surface precision for the following reasons: firstly, because of a contingent poor accuracy in the feed screw and stopper mechanisms for the grinding wheel support or feed rest, secondly due to dimensional dispersion factors peculiar to each work such as a poor working accuracy in its prior machining procedures, thirdly, from possible loading of, or dimensional unevenness in each grinding wheel.

In order to cope with such problems, the present invention proposes the utilization of the efficient performance in the accurate reforming function of a diamond dresser by way of positively introducing the advantageous feature thereof in the grinding operations, not only by a mere application of the diamond dresser therein. That is, the conventional diamond dresser is merely applied to the reforming or dressing procedure prior to the following grinding operations, or in other words, the diamond dresser is generally kept out of its duties during such grinding operations. In this respect, the present invention contemplates the use of the diamond dresser during a grinding operation cycle on a work, and more particularly, according to this invention, the diamond dresser is applicable to such precisional controls as decision of dimensions and surface finish accuracy of a work during a grinding operation cycle.

SUMMARY OF THE INVENTION

In this respect, it is a primary object of the present invention to provide an improved dimensional accuracy maintenance or securing method whereby it is possible to attain and secure an accurate dimensional requirement of a work to be ground to a predetermined dimensional setting.

It is another object of the present invention to provide an improved dimensional accuracy securing method wherein a grinding wheel is reformed or corrected by applying a diamond dresser during a grinding operation cycle so that thus-dressed grinding wheel can conduct a grinding operation on a work to a desired range of surface roughnesses of the work which is priorly determined.

It is a further object of the present invention to provide an improved dimensional accuracy securing method which can standardize the dimensional control of a work in a grinding operation cycle.

It is another object of this invention to provide an improved dimensional accuracy securing method which is likewise applicable to a rotary surface grinding operation in addition to the grinding operations on a cylindrical work.

According to the present invention, briefly summarized by way of a preferred embodiment thereof, there is provided an improved dimensional accuracy securing method for use in a grinding machine having a grinding wheel rotatable in one direction and feedable toward a work with a predetermined depth of grinding feed, a work opposedly disposed against the grinding surface of the grinding wheel and rotatable at such a rate of rotation so as to provide a relative motion with respect to the grinding wheel, thus providing an effective grinding function, wherein means for securing a desired dimensional accuracy of the work is further provided, comprising a holder means for diamond cutter means supported in support means and telescopically adjustable in positioning toward and away from the grinding surface of the grinding wheel, lock means adapted to securely position the holder means of the diamond cutter means, means adapted to adjust a microfeed motion of the holder means of the diamond cutter means toward and away from the grinding surface of the grinding wheel; the means for securing desired dimensional accuracy being arranged in such a manner that a tip of the diamond cutter means may opposedly face against a direction of feed P of the grinding wheel; and the tip of the diamond cutter means may operatively be positioned to define a desired finish grinding distance or length "1" of the work.

The nature, principle, and details of the present invention, as well as further objects and advantages thereof, will become more apparent from the following detailed description with respect to a preferred embodiment of the invention, when read in conjunction with the accompanying drawing, in which like parts are designated with like reference numerals.

DETAILED DESCRIPTION OF THE PREFERRED EMBODIMENT

Description will now be given on preferred embodiments of a grinding machine incorporating an improved dimensional accuracy securing device according to this invention in conjunction with the accompanying drawing.

Figure 1:
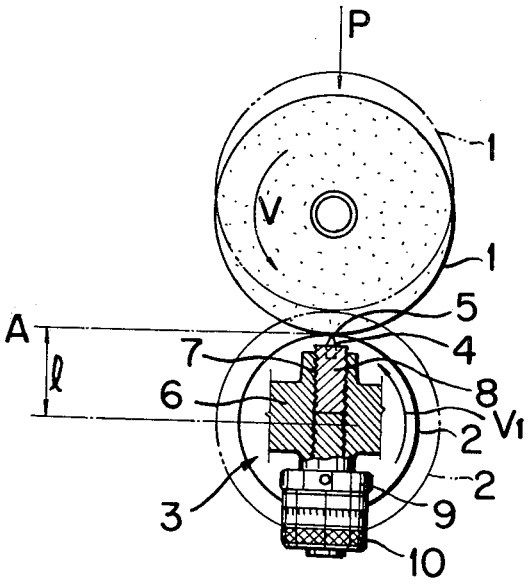
FIG. 1 is a schematic view showing a first embodiment of the present invention in which shown is the function of a dimensional accuracy securing device during a grinding operation cycle.
Figure 2:
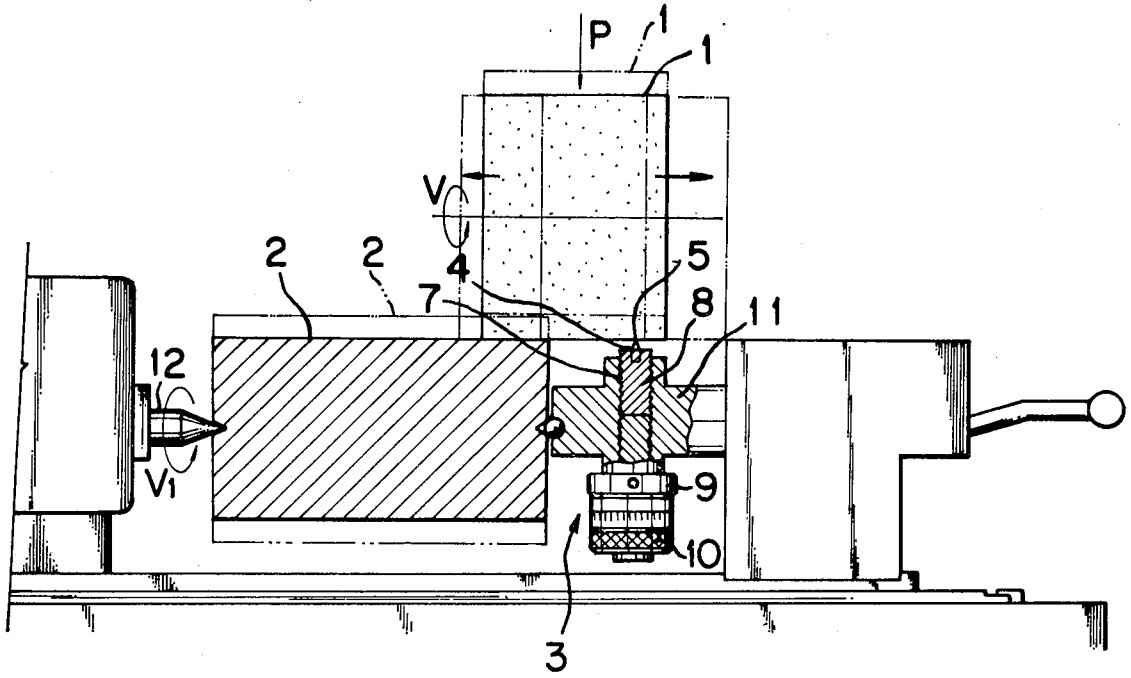
FIG. 2 is an elevational view showing the embodiment of this invention shown in FIG. 1 turned 90° so as to show side elevational view.

Referring now to FIGS. 1 and 2, there is shown, by way of a first embodiment, a grinding machine according to this invention which comprises a grinding wheel 1, a work to be ground to be an accurate cylinder 2, and a dimensional accuracy securing device 3. In these figures, a dot-and-dash line 1 represents a position of the grinding wheel 1 prior to its feed into its grinding position, while a full line 1 shows a position of the grinding wheel when a grinding operation is completed. Likewise, a dot-and-dash line 2 represents a position of the work 2 before it it ground, while a full line 2 shows a position of the work when the grinding operation is completed. According to this invention, the dimensional accuracy securing device 3 is generally placed on the side of the work 2 to be ground, that is, disposed in such a relationship that a diamond unit 4 operatively mounted in the device 3 may oppose against the direction of feed P of the grinding wheel 1, while a diamond tip 5 of the diamond unit 4 being set at a position of finish length or distance "1". With this setting position called as "reference A", it is required to constantly keep the diamond unit 4 at this reference A position during a grinding operation cycle, while enabling the diamond unit 4 to be fine-fed with respect to the reference A according to changes of the grinding conditions. In a practical construction, for instance, there is provided a rest or support 6 having a screw guide 7 therein, and a holder 8 for the diamond unit 4 is placed upon the screw guide 7 in such a manner that it may be adjustably shifted forwardly or backwardly together with the screw guide. There is also provided a lock screw 9 adapted to fix the diamond holder 8 in a selected position, and a microfeed mechanism 10 of a micrometer is operatively connected to the diamond holder and the like. In FIG. 2, there is shown an example of such construction that the above mentioned support 6 is on a tail stock of the grinding machine, and the dimensional accuracy securing device 3 is located at the center of the tail stock. According to such arrangement, the diamond unit 4 can be placed opposedly to the direction of feed P of the grinding wheel 1 without any fear of off-setting. In FIG. 2, there is shown a case of application of such arrangement wherein a tail stock having a morse taper gauge center is designated with the reference numeral 11 and a driving shaft designated with 12.

Next, description will now be given on the grinding operation according to such arrangement in respect of the advantageous features thereof. As a first step, the diamond tip 5 of the diamond unit 4 is positioned to be kept at a position according to a finish dimensional point "1" of a work 2 which corresponds to the prescribed requirement for grinding operation. In practice, the diamond holder 8 is manually adjusted in position with the lock screw 9 loosened and further adjusted finely by way of the microfeed mechanism 10, and upon the coincidence of the tip 5 with the reference A, screw-in the lock screw 9 to have the entire unit locked accordingly. Then, as a second step, the grinding wheel 1 and the work 2 are turned in opposite directions with each other at a predetermined rotating velocities V and V1, respectively, and with such relative velocity of rotation of the two, the grinding wheel 1 is fed in the direction P while sliding left and right as seen in FIG. 2. In this connection, the directions of rotation of the grinding wheel and the work are not necessarily required to be opposite with each other, since it is only essential to have a relative rotating motion or differential velocity of rotation with each other for obtaining a grinding function between the two. When the grinding wheel is fed against the work 2 while sliding left and right in reciprocation, countless number of grains on the grinding wheel surface engages grinding the work 2 while self-producing the grinding edges thereof. When the grinding wheel is completely fed to the depth of grinding feed, i.e., to the finish dimension "1" and reaches its position as shown by the full line 1 in FIGS. 1 and 2, the grinding wheel surface and the tip 5 of the diamond unit 4 come to contact with each other. In this position, the tip 5 of the diamond unit 4 opposes against the grinding wheel 1 to exhibit dressing realtionship with the grinding surface of the wheel, and at the same time work as a stopper to the grinding wheel, thereby to definitely secure the grinding position to the predetermined depth of grinding feed of the grinding wheel 1 toward the work 2. After this contact between the grinding surface of the grinding wheel 1 and the top 5 of the diamond unit 4 was observed, the grinding wheel 1 may be departed away from the work 2. With this dimensional condition, other works may be ground in succession. When there is found any appreciable abrasion or wear on the grinding wheel surface in the successive grinding operations or the tip 5 of the diamond unit 4, the above stated grinding condition may be resumed by manually adjusting the microfeed mechanism 10 so as to restore the due positioning of the diamond unit 4.

With such arrangement of this invention, the following advantageous features may be attained.

(1) By virtue of ready use of the diamond dresser mechanism incorporated in the grinding machine, it is practicably possible to assure the finish dimensions of the works 2 to a prescribed dimensional accuracy. More particularly, a plurality of works 2 may be ground to the same dimension so desired, thus establishing the desired dimensional control on the work. This is possible not only because such conditions as properties (grain, bonded grade, composition, etc.) of the wheel 1, circumferential velocity (V) of the wheel 1 and that (V1) of the work 2 may be predetermined positively in the grinding operations on the plurality of works 2, but also because as a grinding operation is completed upon the reach of the grinding wheel 1 to the tip 5 of the diamond unit 4 positioned in the reference A, the finish dimensional condition of the plurality of works 2 can be exclusively determined according to above stated reference A position.

(2) By virtue of ready use of a dressed grind wheel, which was reformed or corrected by applying a diamond dresser during a grinding operation cycle, it is possible to obtain a surface roughness of a work 2 well within a predetermined range of surface roughnesses desired, thereby to attain a precision prescribed on the works.

As generally accepted, the grinding operation may result in a better dimensional accuracy on the works in comparison with other type of machining operations. In this respect, however, it is essential to secure severer setting basis on the depth of grinding feed, circumferential velocity, depth of feed, etc. of a grinding wheel in contrast with the cutting performance of a cutting tool. According to this invention, by virtue of the advantageous feature that the finish dimension of the work 2 may be exclusively determined by the tip 5 of the diamond unit 4, it is practicably possible to establish a due finish dimensional accuracy of a work 2 within a desired range, and therefore, a surface roughness of a work may be established well within a prescribed range so desired.

(3) Consequently, with combination of such advantageous features as stated in Items (1) and (2) above, generally easier dimensional controls may be practiced on the works in the grinding operations, free from any of such varied dimensional factors as encountered in the conventional machining operations.

Figure 3:
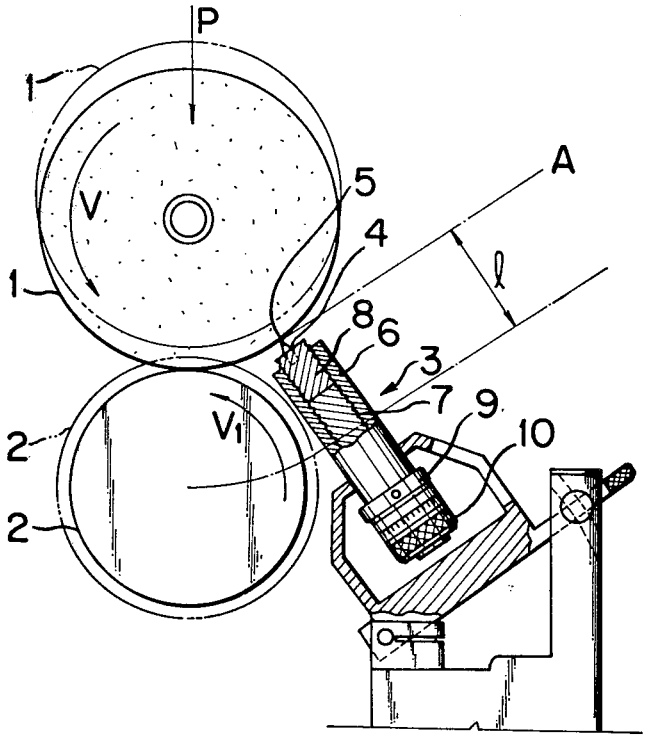
FIG. 3 is a schematic view similar to FIG. 1 showing a second embodiment of the present invention.

Referring next to FIG. 3, there is shown a second embodiment of this invention wherein the dimensional accuracy securing device 3 is now offset in a position away from a work 2 and with respect to the direction of grinding feed P of the grinding wheel 1. Since the substantial arrangement is generally same with aforementioned example shown in FIG. 1, the like parts are designated with the like reference numerals.

In this particular construction, in addition to the advantageous features as mentioned in Items (1), (2) and (3) above, available is such an extra advantage that the dimensional accuracy securing device 3 can now be made an independent unit with respect to the grinding wheel 1 and the work 2. With such arrangement, it is now possible to maintain independently the relative relationship between the dimensional accuracy securing device 3 and the grinding wheel 1, therefore making it possible to freely feed the work 2, instead of the grinding wheel 1, in the axial direction irrespective of the location of the device 3. This feature is particularly advantageous in the case of grinding work on an extrally longitudinal cylindrical work. In this arrangement, it is also possible to add an arrangement such that the device 3 may follow the reciprocating motion of the grinding wheel 1 during a grinding operation cycle. Of cause, this feature is advantageous in practice of a grinding operation on as extrally long work which is fixedly mount in position.

Figure 4:
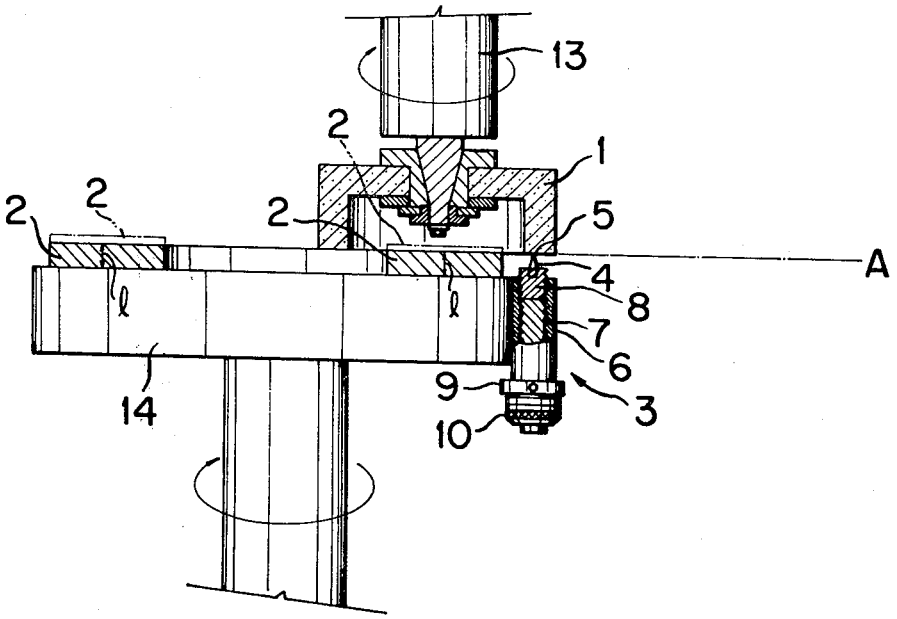
FIG. 4 is a schematic view showing a third embodiment of the invention.

Referring now to FIG. 4, there is shown a third embodiment of the present invention wherein the dimensional accuracy securing device 3 according to this invention is applied to a rotary surface grinding machine. In the figure, there are shown a spindle 13, a rotary table 14, and a work 2 securely placed on the rotary table 14 by using such clamping means as an electromagnetic chuck. The dimensional accuracy securing device 3 is positioned aside the rotary table 14 in such a relationship to have the tip 5 of the device 3 opposedly pointed against the grinding surface of the grinding wheel 1 as typically shown in FIG. 4.

In this construction, it is likewise required to priorly preset the tip 5 of the device 3 with respect to the reference A according to the working conditions. Next, the spindle 13 is rotated relatively with respect to the rotary table 14, thus conducting a rotary surface grinding operation on the surface of the work 2, the advantageous features of this invention as stated in Items (1), (2) and (3) above being attainable accordingly. Besides, it is also possible to apply this invention to a rotary surface grinding wherein a cylindrical grinder is used with its circumferential or front face to be a grinding surface to a work.

Figure 5:
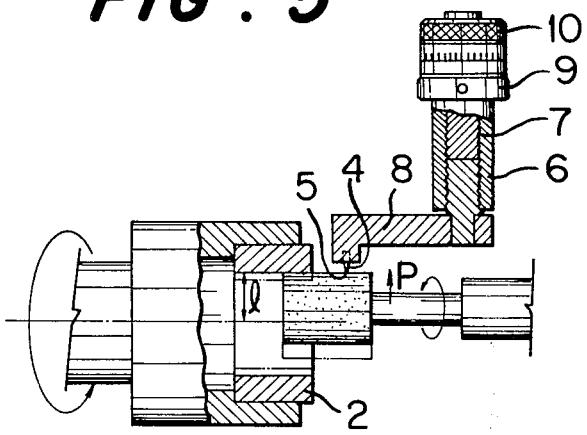
FIG. 5 is a schematic plan view showing a fourth embodiment of the invention.
Figure 6:
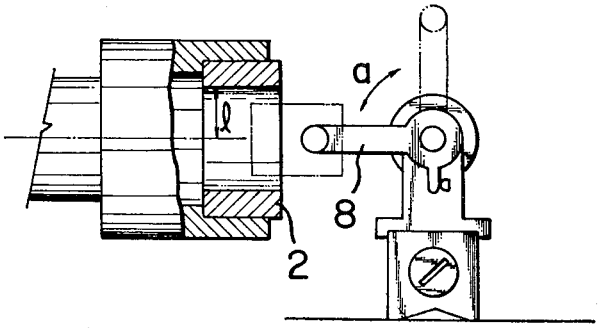
FIG. 6 is a front elevational view showing the fourth embodiment of the invention as shown in FIG. 5.

Next, referring to FIGS. 5 and 6, there is shown a fourth embodiment of this invention wherein there is provided the dimensional accuracy securing device 3 according to this invention in practice to conduct a grinding operation along the interior surface of a work 2.

In this arrangement, the device 3 is arranged as an independent unit with respect to the grinding wheel 1 and the work 2, and securely mounted on a fast head stock (not shown). The device 3 is disposed in a position 180° apart from the direction of grinding feed P of the grinding wheel 1, and with such arrangement, it is advantageous that when it is required to remove the work 2 from the clamp in the tail stock, with the dimensional accuracy securing device 3 once set in position at the reference A, it is possible so to do simply by rotating the diamond holder 8 of the diamond unit 4 about its axis of mount as shown by an arrow "a" in FIG. 6. In this specific arrangement, even if the diamond holder 8 is rotated repeatedly in such handling as stated above, the tip 5 of the diamond unit 4 can be determined in its original positioning so definitely.

As fully described in connection with the embodiments of this invention, according to this invention, there are provided such advantageous features made available from the practice of the invention, i.e., (1) a precise finish performance to a prescribed dimensional accuracy on a work in a grinding operation by way of applying a diamond dresser incorporated in a grinding machine, (2) a desired surface roughness within a prescribed dimensional range, and (3) as a combined effect of the advantageous features as stated in Items (1) and (2) above, a practicably easier yet positive dimensional control possible on a work during a grinding operation cycle.

It should be understood, as indicated hereinbefore, that the preferred embodiments of this invention as described and shown herein does not mean in any way limitations of this invention, but on the contrary, many changes, variations and modifications with respect to the construction and arrangement in practice thereof may further be derived by those skilled in the art to which the present invention pertains, whereby the advantageous characteristics of this invention may be materialized without departing from the spirit and scope of the invention as set forth hereunto in the appended claims.

What is claimed is:

1. In a rotary type surface grinding machine having a cylindrical grinding wheel rotatable in one direction about the axis of the cylinder, a workpiece opposedly disposed against the circumferential grinding surface of said grinding wheel and rotatable at such a rate of rotation so as to produce a relative motion with respect to said grinding wheel and to thus provide an effective grinding function, said grinding wheel and said workpiece being relatively feedable toward and away from each other, said grinding wheel and said workpiece being relatively feedable in a direction with respect to each other parallel to the axis of the cylinder, the method for securing a desired dimensional accuracy in the finish grinding of said workpiece without any possibility of error resulting from the stopping or adjustment of the grinding machine during the grinding operation comprising the steps of:

(a) supporting a diamond cutter means adjacent to but laterally displayed from the workpiece in a selected finish depth-of-grind position relative to the grinding surface of the grinding wheel with the diamond cutter means generally opposing the direction of feed of the grinding wheel toward said workpiece;

(b) moving the grinding wheel laterally over first the diamond cutter means and then the workpiece in a single continuing movement;

(c) incrementally feeding the grinding wheel towards the workpiece and toward the diamond cutter as the grinding wheel passes over both the workpiece and the diamond cutter means until desired finish grind has been completed, the dressing of the grinding wheel by the diamond cutter means on each lateral movement preventing excessive grinding of the workpiece during the grinding operation of that lateral movement so that the grinding operation can be completed without any stoppage or feed adjustment of the grinding machine.

* * * * *